United States Patent [19]

Nagarajan et al.

[11] Patent Number: 4,762,557

[45] Date of Patent: Aug. 9, 1988

[54] REFRACTORY METAL ALLOYS HAVING INHERENT HIGH TEMPERATURE OXIDATION PROTECTION

[75] Inventors: Vaidyanathan Nagarajan; Ian G. Wright, both of Columbus, Ohio

[73] Assignee: Battelle Memorial Institute, Columbus, Ohio

[21] Appl. No.: 103,977

[22] Filed: Oct. 1, 1987

Related U.S. Application Data

[63] Continuation-in-part of Ser. No. 845,279, Mar. 28, 1986, abandoned.

[51] Int. Cl.[4] ..... C22C 29/14

[52] U.S. Cl. ..... 75/244; 419/13; 419/23

[58] Field of Search ..... 75/244; 419/13, 23

[56] References Cited

U.S. PATENT DOCUMENTS

| | | | |
|---|---|---|---|
| 2,077,239 | 4/1937 | Hinnuber | 75/244 |
| 2,180,984 | 11/1939 | Hensil | 75/244 |
| 3,110,589 | 11/1963 | Bechtold | 75/244 |
| 3,110,590 | 11/1963 | Little | 75/244 |
| 3,409,417 | 11/1968 | Yates | 75/244 |
| 3,900,626 | 8/1975 | Brennan | 75/244 |
| 3,914,500 | 10/1975 | Brennan | 75/244 |
| 4,711,665 | 12/1987 | Simkovich | 75/244 |

*Primary Examiner*—Stephen J. Lechert, Jr.
*Attorney, Agent, or Firm*—Klaus H. Wiesmann

[57] ABSTRACT

A high temperature, oxidation resistant alloy useful in high temperature, oxidizing environments such as those encountered in gas turbines, advanced jet engines, high temperature furnaces and glass melting and processing equipment, among others.

The alloy is characterized by selecting a refractory alloy from the group consisting of molybdenum, tungsten, niobium and tantalum having dispersed therein a second phase additive of titanium nitride and a third phase additive of aluminum and titanium. Alternatively, the refractory metals may be molybdenum or tungsten and the second phase additive and third phase additive may be silicon nitride and silicon, or chromium nitride and chromium respectively. The second phase additive must be present in an amount effective to produce a protective scale while not significantly degrading the mechanical properties or decreasing the melting point of the refractory metal, and the third phase must be present in an amount effective to suppress the solubility of nitrogen in the refractory metal and enhance the stability of the second phase while not significantly degrading the mechanical properties, and the ratio of elemental aluminum to elemental titanium, when used, is such that an inner scale of $Al_2O_3$ forms beneath an outer layer of $TiO_2$. The composition retains essentially all of the refractory metal in its elemental form. In this way, the high temperature advantages of the refractory metal are retained while oxidation resistance is greatly improved.

2 Claims, 4 Drawing Sheets

REFRACTORY METAL ALLOYS HAVING INHERENT HIGH TEMPERATURE OXIDATION PROTECTION

This application is a continuation-in-part of Ser. No. 845,279 filed 3/28/86 now abandoned.

FIELD OF THE INVENTION

This invention relates to a novel process and compositions for protecting refractory alloys from oxidation and corrosion in high temperature environments. The invention has utility in protecting the refractory alloys at high temperatures, especially those above 2000° F. (1093° C.) from oxidative attack such as those encountered in newer jet propulsion plants. The higher engine temperatures that can be realized with the invention allow increased power and efficiency.

BACKGROUND OF THE INVENTION

Conventional metallic materials intended for high-temperature use are limited, for practical service, to metal temperatures below a temperature of 1800° to 2000° F. (982° to 1093° C.). Beyond this temperature, the available advanced iron-, nickel-, and cobalt-base alloys do not possess adequate strength for most applications. Hence, for service at temperatures beyond 2000° F. (1093° C.), ceramic materials and refractory metals have to be considered.

Most ceramic materials possess excellent resistance to oxidation and corrosion by high-temperature environments. In addition, they have good high-temperature creep strength. However, ceramic materials have a major limitation to their use as structural materials because of their brittleness. Brittleness can result in unpredictable, catastrophic failure and reduced reliability. Additionally, there are problems in ceramic-to-ceramic and ceramic-to-metal joining.

In comparison, refractory metals possess excellent high-temperature strength and generally have good ductility and toughness. They are weldable and can be joined to produce long sections. However, limitations arise from the fact that the refractory metals do not possess any practical resistance to catastrophic attack by high-temperature oxidizing environments.

Attempts have been made in the past to protect refractory metals from catastrophic oxidation in high-temperature oxidizing environments. Attempts at conventional alloying to promote protective oxide scale formation have been notably unsuccessful. Alloying requires additions of large amounts (approximately 30 percent) of the protective oxide-forming elements (such as silicon and aluminum). Such additions lead to drastic lowering of the melting temperature of the refractory metals and thus, loss of high-temperature strength. Coatings rich in aluminum and/or silicon (aluminide and silicide coatings) have been developed, which, when present on the surface of the refractory metal, oxidize and form protective $Al_2O_3$ and/or $SiO_2$ scales. However, diffusion of aluminum or silicon from the coatings into the substrate often occurs and this eventually has adverse effects on the mechanical properties of the substrate, as well as depleting the protective coating. Although extensive research has been done in the past to optimize coating compositions and to develop barrier layers to minimize the effects of interdiffusion, the latter objective has never been properly realized. Another major disadvantage of these coatings is that even pinholes in the coating can lead to rapid destruction of the substrate being protected.

It has been attempted to provide high temperature alloys by compositions of molybdenum, nitrogen and silicon as exemplified in U.S. Pat. No. 3,110,590 to Little. The advantages of the present invention however are not obtained therein since elemental molybdenum and silicon are not present to any appreciable extent. In the present invention the metallic characteristics of molybdenum are preserved while oxidation resistance is enhanced.

Another method of providing high temperature oxidation resistance for niobium has been attempted by forming a coating consisting of one or more stable compounds using nitrides as in British Patent No. 942,853 to Pokorny. This however is a surface layer over the metal itself and does not protect in the manner of the present invention. Likewise, U.S. Pat. No. 4,492,522 to Rossmann provides for a surface coating of titanium nitride.

BRIEF DESCRIPTION OF THE INVENTION

A high temperature, oxidation resistant alloy comprising a refractory metal selected from the group consisting of molybdenum, tungsten, niobium and tantalum having dispersed therein a second phase additive and a third phase additive, wherein the second and third phase additives comprise respectively titanium nitride, and aluminum and titanium. Alternatively the refractory metal may be selected from the group consisting of molybdenum or tungsten wherein the second and third phase additives comprise respectively silicon nitride and silicon or chromium nitride and chromium. The second phase additive is present in an amount effective to produce a protective scale while not significantly degrading the refractory metal properties and the third phase is present in an amount effective to suppress the solubility of nitrogen in the refractory metal and enhance the stability of the second phase while not significantly degrading the refractory metal properties. Further, the ratio of elemental aluminum to elemental titanium, when used, is such that an inner scale of $Al_2O_3$ forms beneath an outer layer of $TiO_2$.

More specifically there are eight high temperature oxidation resistant alloy systems comprising a refractory metal and second and third phase additives that are integrally mixed with or dispersed in the refractory metal:

a. molybdenum and additives consisting essentially of 1–15% silicon nitride and 1–6% silicon;

b. tungsten and additives consisting essentially of 1–15% silicon nitride and 1–6% silicon;

c. molybdenum and additives consisting essentially of 14–22% chromium nitride and 1–8% chromium, provided that the combined chromium content from the chromium nitride and the free elemental chromium is at least 20%;

d. tungsten and additives consisting essentially of 14–22% chromium nitride and 1–8% chromium, provided that the combined chromium content from the chromium nitride and the free elemental chromium is at least 20%;

e. molybdenum and additives consisting essentially of 1–18% titanium nitride, and a 1–9% titanium and 1–9% aluminum mixture, provided that the total content of elemental aluminum plus elemental titanium cannot exceed 10% as the third phase;

f. tungsten and additives consisting essentially of 1–18% titanium nitride and 1–9% of a titanium and 1-9% aluminum mixture, provided that the total content of elemental aluminum plus elemental titanium cannot exceed 10% as the third phase;

g. niobium and additives consisting of 1-18% titanium nitride and 1-9% of a titanium and 1-9% aluminum mixture, provided that the total content of elemental aluminum plus elemental titanium cannot exceed 10% as the third phase; and h. tantalum and additives consisting of 1-18% titanium nitride and 1-9% of a titanium and 1-9% aluminum mixture, provided that the total content of elemental aluminum plus elemental titanium cannot exceed 10% as the third phase.

DETAILED DESCRIPTION OF THE INVENTION

Figure 1:
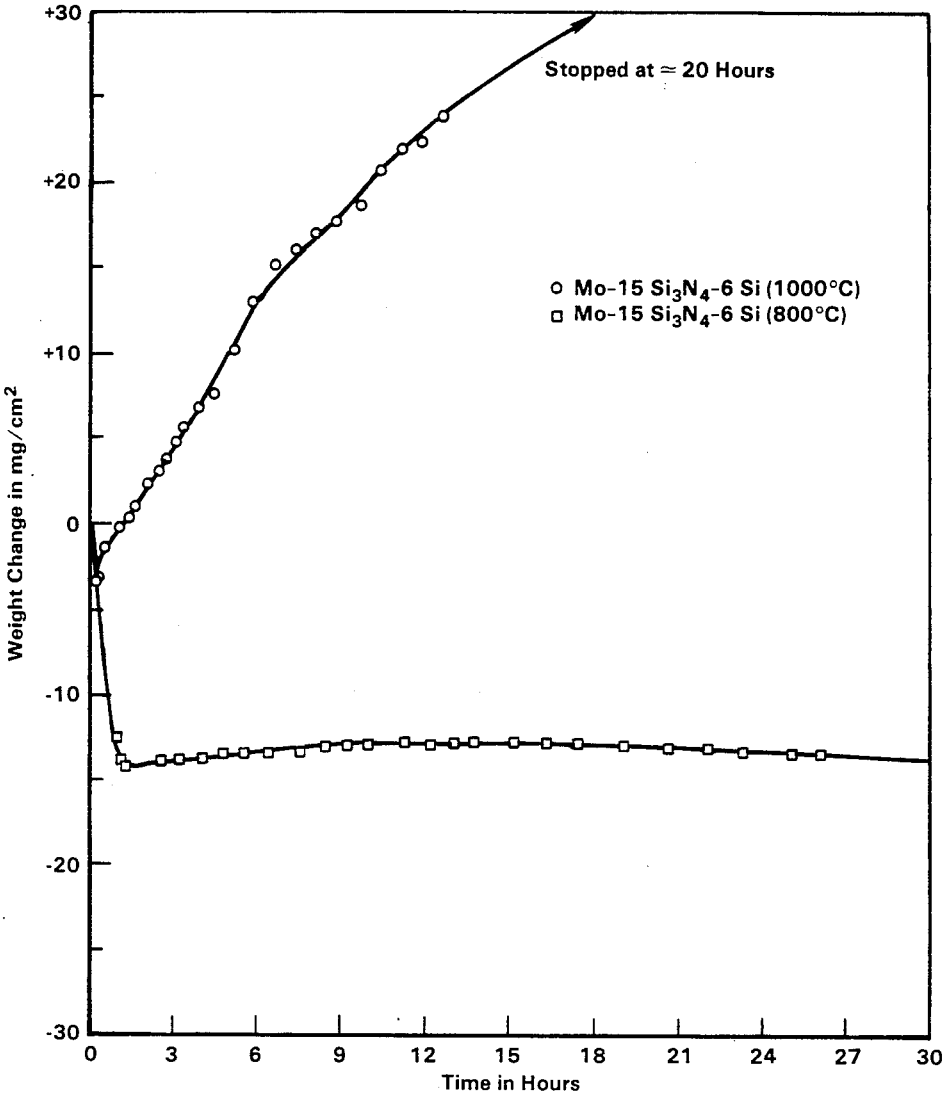
FIG. 1 illustrates the weight change during oxidation testing for two Mo-15$Si_3N_4$-6Si specimens, oxidized for 50 hours at 800° C. and 20 hours at 1000° C.

For practical effective resistance to high-temperature oxidation, the additives used to form the protective scale on refractory metals should satisfy the following criteria:

1. The material should be evenly distributed to be present throughout the refractory metal substrate in sufficient quantities such that it provides an effective reservoir of the protective scale forming element but should be present in such a form that it does not significantly decrease the melting point of the refractory metal;

2. It should be reactive to the oxidizing environment and form a protective layer; and 3. It should be inert to the refractory metal substrate, and should not significantly degrade its mechanical properties.

By significantly degrading the mechanical properties of the refractory metal is meant the reduction of the high-temperature strength, toughness, and low-temperature ductility below those required for the envisaged applications. Typical examples of envisaged applications include components for the hot gas path of gas turbines, high-temperature furnace components, and glass melting and processing equipment, among others. Generally, there will be a trade-off between various properties desired. Given the teachings of the invention, those skilled in the art can readily make adjustment of the compositions that will require only routine testing to determine optimum compositions for the properties desired.

The present invention satisfies the above criteria. The invention allows the use of refractory metals selected from the group consisting of molybdenum, tungsten, niobium, and tantalum. These metals remain essentially in their elemental metallic form so that the high temperature advantages of the refractory metals are retained while their usually weak oxidation resistance is greatly improved. The invention utilizes second phase and third phase additives to increase oxidation resistance. The second phase is inert to the metal substrate but is reactive to the environment. This second phase represents the source and reservoir of the scale-forming element and, on exposure to an oxidizing environment, oxidizes to form a protective scale layer, without reacting with the substrate metal. The selection of the inert second phase is primarily governed by thermodynamic considerations. The second phase should always be added as a compound rather than an elemental addition. This inert phase does not significantly lower the substrate melting temperature. The advantages of producing the alloys by employing this concept are: (1) there is no danger of formation of low melting phases and the loss of refractoriness of the alloy; (2) the protective scale-forming material is present throughout the alloy, and (3) there is no danger of depletion of the protective scale-forming material.

It is important to recognize that without the presence of a third phase as an elemental addition, of silicon, chromium, or a mixture of aluminum and titanium, the alloy systems listed in Table I will not function as desired. First, the presence of the third phase will greatly suppress the solubility of nitrogen in the refractory metal and enhance the stability of the second phase nitrides. Second, if the distribution of the second phase is less than optimum, during the initial oxidation stages the oxide formed by the second phase may not be fully continuous, i.e., gaps may occur in the oxide scale layer. At such locations, the third phase element will itself oxidize to form a healing layer of oxide and thus allow the formation of a continuous and protective layer. It should be emphasized that the third phase element(s) should be added only in small amounts to avoid the deleterious effects of conventional alloying mentioned earlier.

This concept of the invention is applicable to the refractory metals such as molybdenum, tungsten, niobium, and tantalum, provided that compatible reservoirs of protective scale-forming elements are available. Thermodynamic calculations indicate that there are eight alloy systems which have the potential to form protective oxide scales. These systems are listed in Table 1.

TABLE 1

REFRACTORY METAL SYSTEMS SUITABLE FOR HIGH-TEMPERATURE USE OF OXIDIZING ENVIRONMENTS

| System No. | Refractory Metal | Second Phase | Third Phase | Protective Oxide Scale |
|---|---|---|---|---|
| 1 and 2 | Mo or W | $Si_3N_4$ | Si | $SiO_2$ |
| 3 and 4 | Mo or W | $Cr_2N$ | Cr | $Cr_2O_3$ |
| 5-8 | Mo, W, Nb, or Ta | TiN | Al and Ti | outer $TiO_2$/$Al_2O_3$ inner |

This concept was demonstrated with molybdenum alloys and the chosen system was Mo-$Si_3N_4$-Si. This system was chosen because molybdenum forms a very volatile oxide and is an extremely difficult system to protect from catastrophic oxidation. If molybdenum can be protected, then it should be easier to protect the remaining three refractory metals from catastrophic oxidation. Further, Mo, $Si_3N_4$, and Si powders are commercially available in the desired powder size range (about 2 to 4 μm for Mo, about 0.3 μm for $Si_3N_4$ and about 10 μm or less for Si) and hence a simple milling and blending procedure followed by hot-compaction should lead to an alloy containing a very fine and uniform distribution of the $Si_3N_4$ second phase and the Si third phase.

All of the compositions given herein are in weight percent. Thus, for example, the composition 79 wt. percent molybdenum, 15 wt. percent $Si_3N_4$, 6 wt. percent Si is given as Mo-15$Si_3N_4$-6Si.

EXAMPLE 1

The alloys were prepared by milling and blending powders of Mo, $Si_3N_4$, and Si, and compacting the blended powder by vacuum-hot-pressing. The molybdenum powder was purchased from CERAC PURE Inc.; the powder size ranged from 2 to 4 μm. The $Si_3N_4$ powder was purchased from Herman C. Stark Company. The powder size was approximately 0.3 μm. The silicon powder was purchased from CERAC PURE Inc. and the powder size was typically 10 μm or less. However other sources of the powders may be used.

Two alloy compositions of nominally Mo-15 wt. percent $Si_3N_4$-4 wt. percent Si (Mo-15$Si_3N_4$-4Si) and Mo-15 wt. percent $Si_3N_4$-6 wt. percent Si (Mo-15$Si_3N_4$-6Si) were prepared by blending appropriate amounts of the individual powders. The total amount of the blended powder was approximately 250 grams. The powders were further milled and blended using a ball mill containing ceramic balls. The powder size prior to compaction was about 0.1–1.0μm. Compacts were made by vacuum-hot-pressing approximately 100 grams of the blended powders at a pressure of 6000 psi (41 MPa) at a maximum temperature of 2600° F. (1427° C.).

The oxidation runs were carried out in a thermobalance in flowing oxygen and in a muffle furnace in air. For these runs, cylindrical specimens of approximately 3/16 inch (0.476 cm) in diameter and ⅜ inch (0.952 cm) in length were used. These specimens were cut from the compacts using the Electric Discharge Machining technique. Prior to testing, the specimens were ultrasonically cleaned and washed with alcohol. The specimens were then weighed and the specimen dimensions were measured using a micrometer. For oxidation runs in the thermobalance, which were carried out in flowing oxygen at 1472° F. (800° C.) and 1832° F. (1000° C.), the specimens were suspended using platinum wires. For oxidation runs in the muffle furnace, which were carried out in laboratory air at 2600° F. and 2800° F. (1427° and 1538° C.), the specimens were placed in an alumina boat. The duration of the oxidation runs ranged from approximately 24 hours to a maximum of 320 hours. After each oxidation run, the specimens were reweighed and then mounted in epoxy for metallographic examination. The specimens were examined using an optical microscope and a Scanning Electron Microscope (SEM).

The oxidation runs in the thermobalance were carried out at 1472° and 1832° F. (800° and 1000° C.) using the specimens of Mo-15 wt. percent $Si_3N_4$-6 wt. percent Si alloy only. The oxidation runs in the muffle furnace were carried out at 2600° and 2800° F. (1427° and 1538° C.) using the specimens of both Mo-15$Si_3N_4$-4Si alloy and Mo-15$Si_3N_4$-6Si alloy.

The weight change plots for specimens of Mo-15$Si_3N_4$-6Si subjected to oxidation in the thermobalance at 1472° F. (800° C.) for 50 hours and 1832° F. (1000° C.) for 20 hours are shown in FIG. 1. At 1472° F. (800° C.), after an initial weight loss, the specimen formed a protective oxide scale, indicated by the slow weight gain in FIG. 1. At 1832° F. (1000° C.), the specimen gained weight continuously, indicating that a protective oxide scale had grown almost immediately. At the higher temperature, the diffusion rate of silicon would be expected to be higher than that at the lower temperature which in turn would be expected to reduce the time required for the formation of the initial continuous silicon rich oxide layer.

Optical micrographs of the cross-sections of the oxidized specimens for Mo-15$Si_3N_4$-6Si composition are shown in FIGS. 2 through 7. Note the external oxide scale, identified by the brackets marked with an X, and the darker internal $Si_3N_4$ dispersions within the lighter metal background material in the lower half of the photographs. The external oxide scale was identified as silicon rich using the SEM-EDAX system. Typically, the thickness of protective silicon rich oxide scales formed on conventionally prepared iron-base and nickel-base alloys is of the order of approximately 1 to 5 μm. However, the thickness of the oxide scale formed on the Mo-15$Si_3N_4$-6Si alloy appears to be greater than 25 μm; the exact reasons for the formation of such a thick oxide layer are unknown.

Figure 2:
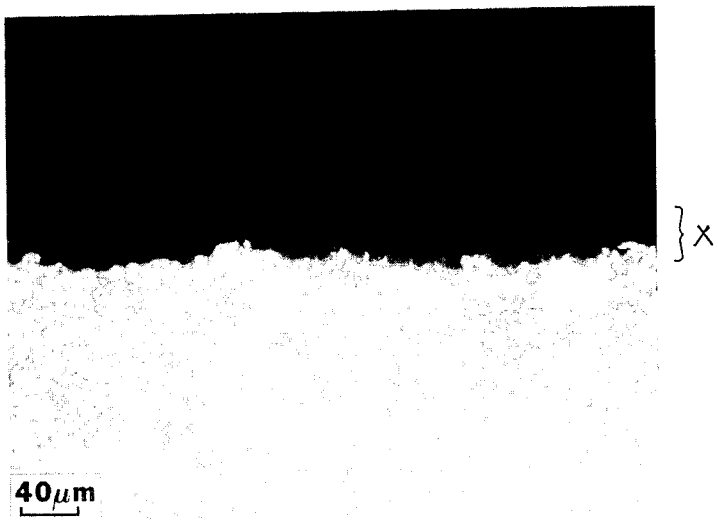
FIGS. 2 and 3 are photographs showing the silicon rich protective oxide layer formed on the Mo-15$Si_3N_4$-6Si specimen at 1472° F. (800° C.) after 50 hours.
Figure 3:
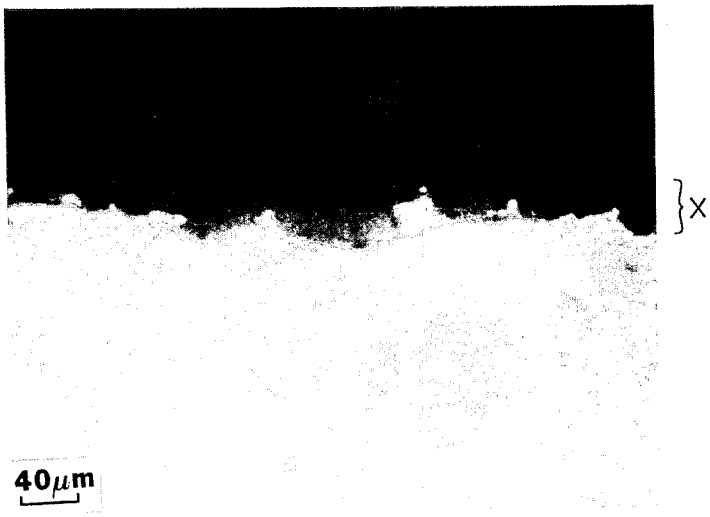
Figure 4:
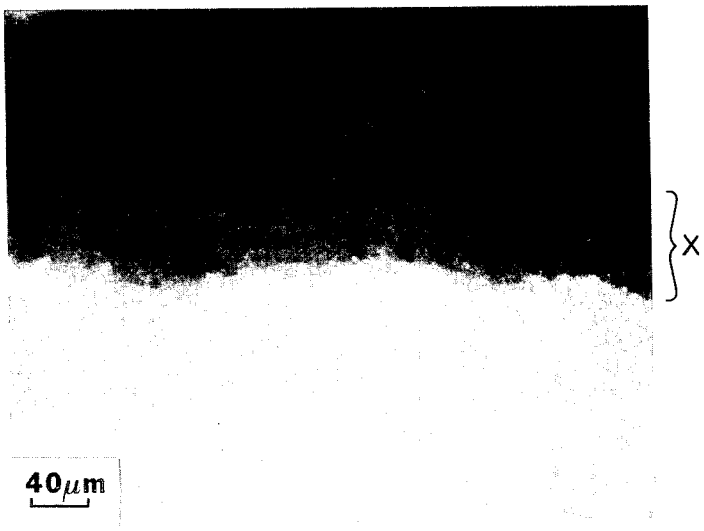
FIGS. 4 and 5 are photographs showing the silicon rich protective oxide layer formed on the Mo-15$Si_3N_4$-6Si specimen at 1832° F. (1000° C.) after 20 hours.
Figure 5:
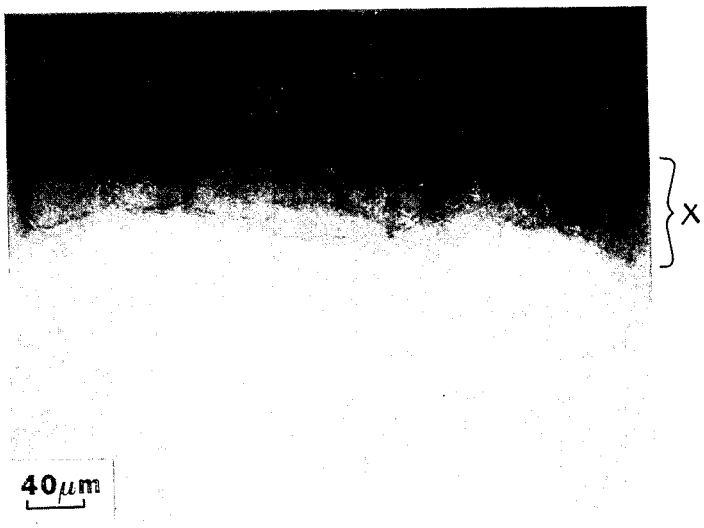
Figure 6:
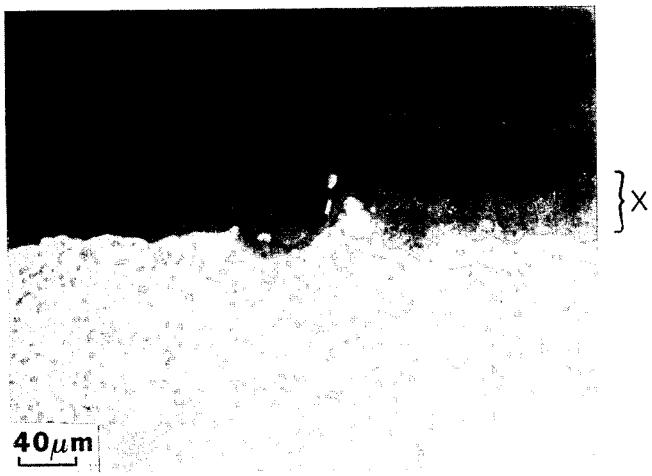
FIG. 6 is a photograph showing the silicon rich protective oxide layer formed on the Mo-15$Si_3N_4$-6Si specimen at 2600° F. (1427° C.) after 23 hours.
Figure 7:
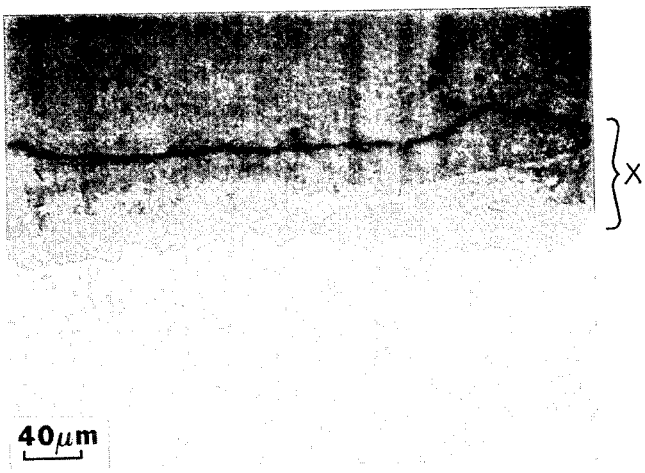
FIG. 7 is a photograph showing the silicon rich protective oxide layer formed on the Mo-15$Si_3N_4$-6Si specimen at 2800° F. (1538° C.) after 23 hours.

FIGS. 2 and 3 show the silicon rich protective oxide layer formed by the specimens oxidized in oxygen at 1472° F. (800° C.). FIGS. 4 and 5 show the silicon rich protective oxide layer formed by the specimens oxidized in oxygen at 1832° F. (1000° C.). Further specimens of Mo-15$Si_3N_4$-6 Si alloy were oxidized at 2600° F. and 2800° F. (1427° and 1538° C.) for 23, 100, and 320 hours in the muffle furnace. FIG. 6 shows the optical micrographs of the specimens oxidized for 23 hours in laboratory air at 2600° F. (1427° C.) and FIG. 7 for 23 hours in laboratory air at 2800° F. (1538° C.). The micrographs show regions on the specimens where part of the oxide scale had spalled off on cooling. Thus the micrographs show only a portion of the protective oxide layer.

The molybdenum alloys of the present invention contain essentially at least 75% of elemental molybdenum present as a metallic in the finished form. The alloys must be metallic to retain the desirable high temperature mechanical properties of the refractory metal. This requirement applies to the other metals included in the invention.

EXAMPLE 2 for a W-$Si_3N_4$-Si System

Since it was observed that in the Mo-$Si_3N_4$-Si alloy system that two alloys, each containing 15 wt. % $Si_3N_4$ and 4 or 6 wt. % Si, formed protective silicon rich oxide scales and, since Mo and W belong to the same group (VI) in the periodic table, it is expected that in the W-$Si_3N_4$-Si system, alloys containing 15 wt. % $SiN_4$ and 4 or 6 wt. % Si would also form protective silicon rich oxide scales. An example for preparing and testing W-15$Si_3N_4$-4Si and W-15$Si_3N_4$-6Si alloys is presented below.

The alloy preparation would involve milling blending powders of W, Si and $Si_3N_4$ using a ball mill. The tungsten powder is available from CERAC PURE Inc. and the powder size should range from 2 to 4 μm. The $Si_3N_4$powder is available from Herman C. Stark Company and the powder size should be approximately 0.3 μm. The Si powder could also be purchased from CERAC PURE Inc. Other sources for the powders may be used.

The powders are further milled and blended in a ball mill by mixing suitable quantities of W, $Si_3N_4$ and Si powders such that the composition of the final alloys is W-15$Si_3N_4$-4Si and W-15$Si_3N_4$-6Si. The total amount of blended powder is approximately 250 grams. The blended powder is compacted by vacuum-hot-pressing approximately 100 grams of the blended powder at a pressure of approximately 6000 to 8000 psi (41 to 55 MPa) and at a temperature of 2600° to 3200° F. (1427° to 1760° C.) to produce cylindrical test specimens of approximately 3/16-inch (0.476 cm) in diameter and approximately ⅜-inch (0.952 cm) in length.

Oxidation runs would be carried out either in a thermobalance or in a muffle furnace at a temperature in the range of 1400° to 3200° F. (760° to 1760° C.) in either oxygen or air using the cylindrical specimens. The duration of the treatment time would be approximately 24 to 320 hours.

The data from the thermobalance would be expected to be very similar to the data obtained in the Mo-$Si_3N_4$-Si system, since the active species in both Mo-$Si_3N_4$-Si and W-$Si_3N_4$-Si alloys are $Si_3N_4$ and Si (which react with oxygen to form a silicon rich oxide scale). Both molybdenum and tungsten are expected to play a very minor role in terms of contributing to the oxidation behavior. In other words, the kinetic data for W-15$Si_3N_4$-6Si alloy, if oxidized at 1472° F. and 1832° F. (800° C. and 1000° C.) in flowing oxygen, would be expected to be very similar to the curve shown in FIG. 1. Furthermore, metallographic examination of the cross sections of the oxidized specimens would reveal structures similar to those shown in FIGS. 2–7. In essence, the W-15$Si_3N_4$-4Si and 6Si alloys would be expected to behave in a mannar almost identical to that shown by Mo-15$Si_3N_4$-4Si and 6Si alloys and form protective silicon rich oxide scales.

EXAMPLES 3–4 for Mo&W-$Cr_2N$-Cr Alloys

As discussed above, molybdenum and tungsten compositions, containing $Si_3N_4$ and Si, would exhibit almost identical chemical and oxidation behavior because they are members of the same group in the periodic table. Hence this example is aimed at molybdenum and tungsten simultaneously.

The alloys of this example are Mo-20$Cr_2N$-8Cr and W-20$Cr_2N$-8Cr. The total chromium-element content (which comes from the $Cr_2N$ and Cr phases) is about 25 wt. %. This is analogous to the chromium level required in iron-, nickel-, or cobalt-base alloys intended for high-temperature oxidizing applications, to ensure the formation of a continuous external oxide layer of chromium oxide. The Mo/W-$Cr_2N$-Cr alloys are intended for high-temperature applications in about the 1800° to 2200° F. (982° to 1204° C.) temperature range, where an external scale based on chromium oxide is known to provide oxidation resistance to conventional alloys.

The alloys of this example are prepared by solid-state-microblending of the required powders in a high-energy ball mill, followed by compaction using Hot-Isostatic-Pressing (HIP) at a pressure of approximately 20,000 psi (138 MPa) and a temperature of 2600° F. to 3200° F. (1427° to 1760° C.). High-temperature oxidation studies in air, oxygen, or a flue gas environment of an industrial furnace burning oil or natural gas would be expected to result in the formation of the desired protective $Cr_2O_3$ scale. Thermodynamic considerations indicate that $Cr_2N$ particles in molybdenum and tungsten should take part in the formation of a $Cr_2O_3$ scale during high-temperature oxidation. Furthermore, the work with Mo-$Si_3N_4$-Si alloys has demonstrated that a nitride particle in the alloy surface can be converted into an oxide particle and contribute to the formation of a protective oxide scale.

EXAMPLES 5, 6, 7 and 8 for Mo/W/Nb/Ta-TiN-Al&Ti Alloys

The basis for the design of these alloys comes from the fact that titanium and silicon belong to Group IV in the periodic table, and their chemical properties are similar. Example 1 has shown that alloys containing silicon nitride can form a silicon rich protective oxide scale during oxidation, hence alloys containing titanium nitride are expected to form a $TiO_2$-based protective scale during oxidation. In contrast to the previous examples, it is also desirable that these alloys contain some level of elemental aluminum. Theoretical oxidation mechanisms indicate that an inner scale of $Al_2O_3$ would form beneath the main outer layer of $TiO_2$. Alloys which form duplex scales consisting of an outer layer of $TiO_2$ and an inner layer $Al_2O_3$ may have wide ranging applications in environments where molten glass is handled. $TiO_2$ does not dissolve in molten glass and $Al_2O_3$ acts as a barrier to oxygen diffusion. If only $Al_2O_3$ is present it will dissolve in the molten glass, and if only a $TiO_2$ layer is present it will not provide oxidation resistance.

Preparation of these alloys by solid-state-blending of powders of molybdenum, tungsten, niobium, or tantalum with powders of titanium nitride, titanium and aluminum in a high-energy vibratory mill is followed by compaction and hot extrusion. A typical alloy would contain 1 wt. % TiN and 10 wt. % of Al and Ti (combined). Oxidation of these alloys in air or oxygen or in a molten glass environment in the temperature range of 1600° to 2400° F. (871° to 1315° C.) would result in the formation of a duplex layer of protective scale consisting of an outer $TiO_2$ layer and an inner $Al_2O_3$ layer.

The above examples serve to illustrate the invention. A high temperature, oxidation resistant alloy comprising a refractory metal is selected from the group consisting of molybdenum, tungsten, niobium and tantalum and a second phase additive and third phase additive is dispersed within the refractory metal. When the refractory metal is molybdenum or tungsten the second phase additive and third phase additive may be respectively, (1) $Si_3N_4$ and Si, (2) $Cr_2N$ and Cr, or (3) TiN, and Al and Ti. Alternatively of the refractory metal is niobium or tantalum the second phase additive and third phase additive is TiN, and Al and Ti. The second phase additive must be present in an amount effective to produce a protective scale while not significantly degrading the refractory metal properties. The third phase must be present in an amount effective to suppress the solubility of nitrogen in the refractory metal and enhance the stability of the second phase while not significantly degrading the refractory metal properties, and the ratio of elemental aluminum to elemental titanium, when used, is such that an inner scale of $Al_2O_3$ forms beneath an outer layer of $TiO_2$. It is important that the refractory metal alloys of the present invention have essentially all of the selected refractory metal present in metallic form in the composition of the finished converted product in order for the converted product to retain the advantages and characteristics of the refractory metals. Thus for example when molybdenum is selected with a $Si_3N_4$ second phase, and a silicon third phase, the final product composition obtained is a metal alloy which contains a dispersion of a ceramic ($Si_3N_4$), with a minor phase present as silicon in solid solution and less than 5% as a dispersion of an intermetallic compound such as $MoSi_2$. In comparison, in the known prior art, as in Little et al discussed earlier, the final material is described as an intermetallic compound or compounds with a dispersion of a ceramic. Elemental molybdenum and silicon are not present in any appreciable extent.

The preferred powder sizes prior to compaction and heat treatment are preferably in the range of about 0.01 to 0.1 μm. Sizes in this range will enable good dispersions to be obtained that will give optimum oxidation protection. The particle sizes in Example 1 were 0.1-1.0μm which are sufficient to allow the formation of the desired oxide scale; however, it is known that in order to obtain optimum mechanical properties particle sizes below 0.1 μm are preferred. Moreover, if the particle sizes are too large, gaps may form in the initially formed protective scale layer.

More specifically the high temperature, oxidation resistant composition comprises a metal selected from the group consisting of molybdenum, tungsten, niobium and tantalum; and second and third phase additives selected from the group consisting of (1) $Si_3N_4$ (1-15%) and Si (1-6%) when the metal selected is molybdenum or tungsten; (2) $Cr_2N$ (14-22%) and Cr (1-8%) when the metal selected is molybdenum or tungsten, provided that the combined chromium content from the $Cr_2N$ and the free elemental chromium is at least 20%; and (3) TiN (1-18%), Al (1-9%) and Ti (1-9%), when the metal selected is molybdenum, tungsten, niobium, or tantalum, provided that the total content of elemental aluminum plus elemental titanium cannot exceed 10% as the third phase. The advantages of the present invention are realized by a composition wherein the selected metals are essentially present in the composition in elemental form. The above presently preferred compositional ranges are illustrated in Table II for greater clarity.

The compositional ranges listed above are those preferred for obtaining the advantages of the invention. Although specific sources of starting materials have been given any other powders that have appropriate characteristics (e.g. purity, size, etc.) are acceptable. While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

TABLE II

PRESENTLY PREFERRED COMPOSITIONAL RANGES SUITABLE FOR USE IN HIGH TEMPERATURE OXIDIZING ENVIRONMENTS

| System No. | Refractory Metal | Second Phase | Third Phase | Protective Oxide Scale |
|---|---|---|---|---|
| 1 | Mo (79-98%) | $Si_3N_4$ (1-15%) | Si (1-6%) | $SiO_2$ |
| 2 | W (79-98%) | $Si_3N_4$ (1-15%) | Si (1-6%) | $SiO_2$ |
| 3 | Mo (70-85%) | $Cr_2N$* (14-22%) | Cr* (1-8%) | $Cr_2O_3$ |
| 4 | W (70-85%) | $Cr_2N$* (14-22%) | Cr* (1-8%) | $Cr_2O_3$ |
| 5 | Mo (72-97%) | TiN (1-18%) | Al(1-9%)** Ti(1-9%) | outer $TiO_2/Al_2O_3$ inner |
| 6 | W (72-97%) | TiN (1-18%) | Al(1-9%)** Ti(1-9%) | outer $TiO_2/Al_2O_3$ inner |
| 7 | Nb (72-97%) | TiN (1-18%) | Al(1-9%)** Ti(1-9%) | outer $TiO_2/Al_2O_3$ inner |
| 8 | Ta (72-97%) | TiN (1-18%) | Al(1-9%)** Ti(1-9%) | outer $TiO_2/Al_2O_3$ inner |

All % are in weight percent.
*The total combined % of chromium from $Cr_2N$ and the free elemental chromium is at least 20%.
**The total % of the elemental Al plus elemental Ti mixture cannot exceed 10% as the third phase.

We claim:

1. A high temperature, oxidation resistant composition comprising:
   a. a refractory metal selected from the group consisting of molybdenum, tungsten, niobium and tantalum; and
   b. second and third phase additives selected from the group consisting of:
      (1) $Si_3N_4$ (1-15%) and Si (1-6%), when the metal selected in (a) is molybdenum or tungsten;
      (2) $Cr_2N$ (14-22%) and Cr (1-8%), when the metal selected in (a) is molybdenum or tungsten, provided that the combined chromium content from the $Cr_2N$ and the free elemental chromium is at least 20%; and
      (3) TiN (1-18%), and a mixture of Al (1-9%) and Ti (1-9%), when the metal selected in (a) is molybdenum, tungsten, niobium, or tantalum, provided that the total content of elemental aluminum plus elemental titanium cannot exceed 10% as the third phase;

wherein the selected metals are present in the composition in elemental form and less than 5% is a dispersion of $MoSi_2$.

2. The alloy of claim 1 wherein the dispersed second phase comprises particle sizes of about 0.01 to 0.1 μm.

* * * * *

UNITED STATES PATENT AND TRADEMARK OFFICE
CERTIFICATE OF CORRECTION

PATENT NO. : 4,762,557
DATED : August 9, 1988
INVENTOR(S) : Vaidyanathan Nagarajan and Ian G. Wright It is certified that error appears in the above-identified patent and that said Letters Patent are hereby corrected as shown below:

Column 8, line 35, after contain "1" should read -- 18 --;

Column 8, line 50, after alternatively "of" should read -- if --.

Signed and Sealed this

Seventeenth Day of January, 1989

*Attest:*

DONALD J. QUIGG

*Attesting Officer*

*Commissioner of Patents and Trademarks*